US008220396B2

(12) United States Patent
Ritt

(10) Patent No.: US 8,220,396 B2
(45) Date of Patent: Jul. 17, 2012

(54) PROJECTILE

(75) Inventor: Stefan Andreas Ritt, Stuttgart (DE)

(73) Assignee: Deutsches Zentrum fuer Luft- und Raumfahrt e.V., Cologne (DE)

( * ) Notice: Subject to any disclaimer, the term of this patent is extended or adjusted under 35 U.S.C. 154(b) by 0 days.

(21) Appl. No.: 13/018,651

(22) Filed: Feb. 1, 2011

(65) Prior Publication Data

US 2011/0192314 A1 Aug. 11, 2011

Related U.S. Application Data

(63) Continuation of application No. PCT/EP2009/060112, filed on Aug. 4, 2009.

(30) Foreign Application Priority Data

Aug. 11, 2008 (DE) ..... 10 2008 038 258

(51) Int. Cl.
*F42B 10/02* (2006.01)
*F42B 12/74* (2006.01)
*F42B 14/06* (2006.01)

(52) U.S. Cl. ..... 102/502; 102/520; 102/529

(58) Field of Classification Search ..... 102/501, 102/502, 520, 529, 444
See application file for complete search history.

(56) References Cited

U.S. PATENT DOCUMENTS

| | | | | |
|---|---|---|---|---|
| 3,186,642 | A | 6/1965 | Silverp | |
| 3,791,303 | A | 2/1974 | Sweeney et al. | |
| 3,952,662 | A * | 4/1976 | Greenlees | 102/400 |
| 5,016,536 | A * | 5/1991 | Brighton | 102/430 |
| 5,450,795 | A * | 9/1995 | Adelman | 102/444 |
| 5,652,407 | A | 7/1997 | Carbone | |
| 5,936,190 | A | 8/1999 | Buzick | |
| 6,012,395 | A * | 1/2000 | Saxby | 102/502 |
| 6,302,028 | B1 | 10/2001 | Guillot-Ulmann et al. | |
| 6,371,028 | B2 * | 4/2002 | Saxby | 102/502 |
| 7,743,709 | B2 * | 6/2010 | Kolnik et al. | 102/521 |
| 7,861,657 | B2 * | 1/2011 | Danon et al. | 102/502 |
| 2004/0129435 | A1 | 7/2004 | Parrish | |
| 2008/0000464 | A1 | 1/2008 | Campo et al. | |
| 2009/0320710 | A1 * | 12/2009 | MacDougall et al. | 102/502 |
| 2010/0077832 | A1 * | 4/2010 | Turner et al. | 73/12.05 |

FOREIGN PATENT DOCUMENTS

| | | |
|---|---|---|
| DE | 3629941 | 3/1988 |
| EP | 0 488 911 A2 | 6/1992 |
| FR | 2 309 827 | 11/1976 |
| GB | 2032070 | 4/1980 |
| WO | WO 95/00815 | 1/1995 |
| WO | WO 2007/053130 A1 * | 5/2007 |
| WO | WO 2007/066324 A1 | 6/2007 |

OTHER PUBLICATIONS

Bertke, "Strcutural Element and Real Blade Impact Testing," *AFWAL-TR-82-2121*, Jan. 1983.

(Continued)

*Primary Examiner* — James Bergin
(74) *Attorney, Agent, or Firm* — Womble Carlyle Sandridge & Rice, LLP

(57) ABSTRACT

To provide a projectile for bird strike tests, comprising a gel-like or jelly-like material, which makes reproducible and representative results in bird strike tests possible, it is proposed that the projectile comprise a stabilizing device arranged in the projectile for stabilizing the gel-like or jelly-like material.

27 Claims, 13 Drawing Sheets

OTHER PUBLICATIONS

Budgey, "Artifical Bird Proposal," *Central Science Laboratory*, 2000.
McCarthy et al., "Bird Impact on a Fibre Metal Laminate (GLARE) Aircraft Leading Edge with an SPH Approach," *Presentation, EuroPAM 2004*, Paris, Oct. 2004.
Publication: Certification Specification for Large Aeroplanes, CS-25, *Published by the European Aviation Safety Agency*, Amendment 2, Oct. 2006.
Allcock et al., "The Development of a Dummy Bird for Use in Bird Strike Research," *Aeronautical Research Council*, Current Paper No. 1071, 1969.
Barber et al., "Characterization of Bird Impacts on a Rigid Plate: Part 1," Technical Report AFFDL-TR-75-5, Jan. 1975.
Bertke et al., "Impact Damage on Titanium Leading Edges from Small Soft-Body Objects," Technical Report AFML-TR-79/4019, Feb. 1979.
Bertke, "Local Leading Edge Damage From Hard Particle and Soft Body Impacts (task IV B)," Technical Report AFWAL-TR-82/2044, May 1982.
Allan et al., "The costs of Birdstrikes to Commercial Aviation," *2001 Bird Strike Committee-USA/Canada, Third Joint Annual Meeting*, 2001.
Bauer et al., "Experimental Investigation of Impact Pressures Caused by Gelatin Simulated Birds and Ice," Technical Report UDR-TR-78-114, Mar. 1979.
Budgey, "The Development of a Substitute Artificial Bird by the International Birdstrike Research Group for Use in Aircraft Component Testing," *Published by the International Bird Strike Committee, IBSC25/WP-IE3*, Apr. 2000.
Cassenti, "Hugoniot Pressure Loading in Soft Body Impacts," *20th Structures, Structural Dynamics and Materials Conference*, Apr. 1979.
Challita et al., "The Scaling of Bird Impact Loads," Technical Report AFFDL-TR-79/3042, Jun. 1979.
Challita et al., "Effects of Bird Orientation at Impact on Load Profile and Damage Level," Technical Report AFWAL-TR-80/3009, Jun. 1980.
Challita, "Validation of a Bird Substitute for Development and Qualification of Aircraft Transparencies," Technical Report AFWAL-TR-80/3098, Oct. 1983.
Derose et al., "Model and Sabot Design and Launching Techniques," *NASA-Ames Research Center*.
Downer, "When the Chick Hits the Fan: Representatives and Reproducibility in Technological Tests," *Social Studies of Science*, 2007, pp. 7-26, vol. 37, No. 1.
Engblom et al., "Nonlinear Dynamic Response of Composite Rotor Blades," Technical Report AFOSR-TR-85/1056, Oct. 1983.
Frischbier, "Vogelschlag in Flugtriebwerken—eine impulsartige Fluid-Struker-Wechselwirkung in der Triebwerksauslegung," *Published by MTU Aero Engines*, 2002.
Georgiadis et al., "Bird-Strike Simulation for Certification of the Boeing 797 Composite Moveable Trailing Edge," *Composite Structures*, 2008, pp. 258-268, vol. 86.
Goyal et al., "Robust Bird-Strike Modeling Based on ALE Formulation Using LS-DYNA," *47th AIAA/ASME/ASCE/AHS/ASC Structures, Structural Dynamics, and Materials Conference*, May 2006.
Hamershock et al., "Determination of Body Density for Twelfe Bird Species," Technical Report WL-TR-93/3049, Apr. 1993.
Horlsley, "The 'Rolls-Royce'Way of Vaildating fan Inegrity," *Published by the American Institute of Aeronautics and Astronautics Inc.* 1993.
Kerten et al., "Rechnerische Simulation von vogelschlschlaginduzierten Schäden am Tragwerk der Do328," DGLR-JT98-267, 1998.
Kersten et al., "Rechnerische Vogelschlagsimulation an Strukturkomponenten von Verkhrsflugzeugen, (Numerical Bird Strike Simulation on Aircraft Structures)" *Published in "Vogel und Luftverkeher, "* 22, 2002, pp. 5-15.
Kirtil et al., "Simulating the Impact Behaviour of Composite Aircraft Structures," *Conference Proceedings, ABAQUS User's Conference 2003*, Vienna, Nov. 2003.
McCallum et al., "The Influence of Bird-Shape in Bird-Strike Analysis," *5th European LS-DYNA Users Conference*, 2005.
McCarthy et al., "Modeling of Bird Strike on an Aircraft Wing Leading Edge Made from Fibre Metal Laminates—Part 1: Material Modeling," *Applied Composite Materials 11* pp. 295-315, 2004.
McCarthy et al., "Material Modeling of a Fibre Metal Laminate (GLARE) for Soft Body Impact Problems," *Presentation, EuroPAM 2004*, Paris, Oct. 2004.
McGovern, "Bird Strike Design Manual," *British Aerospace Aircraft Group*, Jun. 1984.
McNaughtan et al. "Bird Impact Tests of Vulcan Aircraft Windscreens," *Royal Aircraft Establishment*, Technical Report No. 65148, Jul. 1965.
McNaughtan et al. "The Design of Leading-Edge and Intake Wall Structure to Resist Bird Impact," *Royal Aircraft Establishment*, Technical Report No. 72056, Mar. 1972.
Mendler et al., "Birdstrike Resistance of Aircraft Structures," *Conference Proceedings, ABAQUS User's Conference*, Stuttgart, Oct. 1998.
Peterson et al., "Bird Impact Forces in Aircraft Windshield Design," Technical Report AFML-TR-76-54, Mar. 1976.
Peterson et al., "Bird Impact Forces and Pressures on Rigid and Compliant Targets," Technical Report AFFDL-TR-77-60, May 1978.
Sanders, "The AEDC Bird Impact Test Facility," *Transparent Aircraft Enclosures Conference*, Feb. 1973.
Stoll et al., "Finite Element Simulation of High-Speed Soft-Body Impacts," AIAA/ASME/ASCE/AHS/ASC Structures, Structural Dynamics, and Materials Conference and Exhibit, 38th and AIAA/ASME/AHS Adaptive Forum, *Collection of Techincal Papers*, Pt. 1 (A97-24112 05-39),1997.
Storace et al., "Analytical and Experimental Investigation of Bird Impact on Fan and Compressor Blading," *AIAA/ASME/ASCE/AHS 24th Structures, Structural Dynamics and Materials Conference, Part 2*, May 1983.
Wilbeck, "Impact Behavior of Low Strength Projectiles," Technical Report AFML-TR-77-134, Jul. 1978.
Wilbeck et al., "The Development of a Substitute Bird Model," *Published by the American Society of Mechanical Engineers*, 81-GT-23, Mar. 1981.
Wilbeck et al., "The Development of a Substitute Bird Model," *Published in the Journal of Engineering for Power*,vol. 103/725, Oct. 1981.
Wilbeck, "Impact, Bird Impact Loading," Shock Vib. Bull. 48, 1978, 115-122.
Wisnom, "Prediction of Penetration of curved metal Stiffened Panels due to Birdstrike," *Published in The Aeronautical Journal*, 1990, pp. 313-317, vol. 94.
Article: "Kugeln und Schrot in Aspik (Gelation Blocks Helpsin the Investigation of Projectiles and the Development of Protective Clothing)" *GELITA Uptodate*, 2007.
Briefing Notes: "Flight Operations Briefing Notes, Operating Environment, Birdstrike Threat Awareness," *Published b Airbus Customer Services*, Oct. 2004.
Leaflet: Regulations Concerning the Impact Withstandability in Service of Combustion-Engined Railcars of Multiple Unit Trains, *Published by the International Union of Railways*, 1st Edition, Updated Jan. 1, 1987.
Leaflet: "Fitting of Front Windows, Side Windows, and Other Windows Installed in Drivers'Cabs of Motive Power Units with Internal Combustion Engines, and in Driving Trailers (With a View to Ensuring Protection of the Staff)," *Published by the International Union of Railways*, 1st Edition, Updated Jan. 1, 1987.
Leaflet: "Layout of Driver's Cabs in Locomotives, Railcars, Multiple Unit Trains and Driving Trailers," *Published by the International Union of Railways (UIC) 4th Edition*, Jul. 2002.
Publication: "Standard Test Method for Bird Impact Testing of Aerospace Transparent Enclosures," ASTM F 330-89, *Published by ASTM International*, Reapproved 1999.

* cited by examiner

PROJECTILE

This application is a continuation of international application number PCT/EP2009/060112 filed on Aug. 4, 2009 and claims the benefit of German application number 10 2008 038 258.2 filed on Aug. 11, 2008.

The present disclosure relates to the subject matter disclosed in international application number PCT/EP2009/060112 of Aug. 4, 2009 and German application number 10 2008 038 258.2 of Aug. 11, 2008, which are incorporated herein by reference in their entirety and for all purposes.

BACKGROUND OF THE INVENTION

The present invention relates to a projectile, comprising a gel-like or jelly-like material.

Such projectiles are used, in particular, for bird strike tests as a substitute for real birds. Bird strike tests are carried out at wind power plants, for example, and, in particular, are mandatory for the certification of aircraft and trains. To that end, projectiles are fired at a high speed by a gas gun at areas of the wind power plants, the aircraft or the trains that are to be tested. Owing to the high speeds and the resulting high air resistance during a flight phase of the projectiles, deformation and/or oscillation of the projectile occurs, particularly when artificial projectiles of the above-mentioned kind are used, which leads to distortion of the test results.

U.S. Pat. No. 5,936,190 A, FR 2 768 504 A1, EP 0 488 911 A2, U.S. Pat. No. 3,791,303 A and WO 2007/066324 A1 disclose projectiles which are fired by hand firearms at animals and/or human beings.

SUMMARY OF THE INVENTION

In accordance with the present invention, a projectile is provided, which makes reproducible and representative results in bird strike tests possible.

In accordance with an embodiment of the invention, a stabilizing device arranged in the projectile is provided for stabilizing the gel-like or jelly-like material.

A deformation of the projectile, in particular, in the flight phase is reduced, preferably completely avoided, by the stabilizing device. This leads to a reproducible shape of the projectile upon impact with a target and, therefore, to reproducible results of the bird strike tests.

In an embodiment of the invention it may be provided that the gel-like or jelly-like material comprises gelatin or consists of gelatin. As a result, the projectile is low-priced and easy to produce.

It is expedient for the gel-like or jelly-like material to be formed from a mixture of, for example, approximately four proportions of water and, for example, approximately one proportion of gelatin.

It is particularly expedient for the gel-like or jelly-like material to comprise ballistic gelatin or to consist of ballistic gelatin. The physical characteristics and the physical behavior of muscles can be recreated well by the use of ballistic gelatin.

As an alternative or supplement to this, it may be provided that the gel-like or jelly-like material comprises silicone rubber, glycerin soap, starch, polymer gel, caoutchouc, latex and/or plasticine or consists of silicone rubber, glycerin soap, starch, polymer gel, caoutchouc, latex and/or plasticine. Plasticine is a trademark registered in the name of Flair Leisure Products PLC.

It is expedient for the gel-like or jelly-like material to have a gel strength of from, for example, approximately 200 Bloom to, for example, approximately 300 Bloom. The physical characteristics and the physical behavior of muscles can then be recreated well.

Advantageously, the gelatin is a type A gelatin.

In an embodiment of the invention it may be provided that the projectile comprises hollow bodies, in particular, hollow balls.

It is expedient for at least part of the gel-like or jelly-like material to be arranged in the hollow bodies. The projectile can be stabilized in a simple way by using hollow bodies as subunits inside the projectile. Furthermore, adaptation of the density of the projectile is thereby possible.

It is also expedient for the hollow bodies to be surrounded at least partly by the gel-like or jelly-like material.

It is particularly expedient for the hollow bodies to be formed at least partly of a brittle material, in particular, from glass or polycarbonate. In this way, the shell of the hollow bodies is of stable construction, and little influence of the hollow bodies on the behavior of the projectile upon impact with a target is ensured.

It is particularly expedient for the stabilizing device to comprise hollow bodies that are connected to one another. An improved stabilization of the projectile is thus made possible by the hollow bodies present in the projectile.

In an embodiment of the invention it may be provided that the projectile has, at least in sections thereof, a substantially cylindrical shape. In this way, a bird strike can be simulated well.

As an alternative or supplement to this, it may be provided that the projectile is, at least on one side thereof, of substantially hemispherical configuration.

It is expedient for the projectile to be of substantially hemispherical configuration on either side of a middle section. As a result, the projectile has better aerodynamics and hence a reduced deformation in the flight phase.

In an embodiment of the invention it may be provided that the projectile is configured, at least in sections thereof, substantially as an ellipsoid, in particular, as an ellipsoid of revolution. In this way, the projectile has good aerodynamics and hence reduced deformation in the flight phase.

In particular, for use in single-impact tests, i.e., with only one impact per target to be tested, it is provided in an embodiment of the invention that the projectile has a mass of at least approximately 1.5 kg.

Furthermore, it is then expedient for the projectile to have a mass of at most approximately 4 kg.

It is particularly preferred for the projectile to have a mass of approximately 1.814 kg (4 lb) or of approximately 3.628 kg (8 lb).

In particular, for use in multiple-impact tests, i.e., with several impacts per target to be tested, it is advantageously provided that the mass of the projectile is preferably at least approximately 50 g and preferably at most approximately 1 kg. For example, tests with 8 projectiles, each weighing 700 g or 16 projectiles, each weighing 85 g are representative of flocks of birds.

In an embodiment of the invention it may be provided that the stabilizing device is formed, at least in sections thereof, of a material having a high brittleness. In this way, upon impact of the projectile with a target, the stabilizing device is essentially immediately destroyed and, therefore, has little, in particular, no, influence on the behavior of the projectile upon target impact.

It is advantageous for the stabilizing device to be formed, at least in sections thereof, of a material having a high stiffness. The stability of the projectile can thereby be increased.

It is expedient for the stabilizing device to be formed, at least in sections thereof, of, in particular, impregnated and/or non-absorbent, paper, or, in particular, impregnated and/or non-absorbent, cardboard. As a result, the stabilizing device can be constructed in a simple way. Moreover, the stability of the projectile can be increased by using stiff paper or stiff cardboard.

In an embodiment of the invention it may be provided that the stabilizing device comprises at least one stabilizing element. Owing to the use of at least one stabilizing element, the stabilizing device can be arranged particularly easily and flexibly in and/or on the projectile.

It is advantageous for a maximum extent of the at least one stabilizing element to be at most approximately one tenth, preferably at most approximately one fiftieth, of a maximum extent of the projectile.

It is expedient for the at least one stabilizing element to be of substantially bar-shaped configuration. In this way, in particular, a three-dimensional structure is easy to construct by means of the stabilizing elements.

It is particularly expedient for the stabilizing device to be formed, at least in sections thereof, of stabilizing elements arranged in a geometrical pattern. A particularly stable three-dimensional structure of the stabilizing device is thereby ensured.

It is advantageous for the geometrical pattern to be based on a cubic or tetrahedral basic shape. In this way, a simple construction of a stable stabilizing device is possible.

As an alternative or supplement to this, it may be provided that the stabilizing device comprises at least one, for example, spinal column-like, main support. In this way, in particular, a central section of the projectile can be easily stabilized.

As a supplement to this, it may be provided that the stabilizing device comprises a plurality of, for example, rib-shaped, stabilizing elements which are arranged, in particular, regularly, on the main support. An additional stabilization of the projectile which is already stabilized by the main support is thus possible.

In an embodiment of the invention it may be provided that a material of which at least a section of the stabilizing device is formed has substantially the same density as the gel-like or jelly-like material. In this way, an influence of the stabilizing device on the behavior of the projectile upon impact with the target can be reduced, in particular, completely avoided.

It is advantageous for the stabilizing device to comprise a material, in particular, to consist of a material which is workable by laser sintering. In this way, a user-defined shape of the stabilizing device can be easily produced, in particular, by rapid prototyping. For this purpose, a laser for sintering thermoplastic plastic powder, for example, polypropylene or polyamide, is guided, for example, in accordance with the specifications of a CAD model. A free design of the geometry of the stabilizing device is thus possible.

It is advantageous for the projectile to be surrounded, at least in sections thereof, by a substantially water-impermeable material. A drying-out of the projectile and hence a change in the physical characteristics during storage of the projectile can thereby be avoided.

It is expedient for the projectile to be provided with a water-impermeable coating. In this way, a drying-out can be prevented particularly easily.

The projectile in accordance with the invention is suited, in particular, for use in a combination of a projectile and a sabot for receiving and accelerating the projectile in an acceleration device.

The combination of projectile and sabot may have the advantages set forth above in conjunction with the projectile in accordance with the invention.

It is advantageous for the sabot to comprise a receptacle for the projectile, the shape of which, at least in sections thereof, is complementary to that of at least one section of the projectile. In this way, the projectile can be easily received, in particular, loosely held, in the sabot.

It is advantageous for the sabot to be constructed so as to be separable along a longitudinal center plane. As a result, the projectile can be easily placed in the sabot and removed from it.

The combination of projectile and sabot is suited, in particular, for use in an acceleration device configured, for example, as a gas gun.

The acceleration device with the combination of the projectile in accordance with the invention and the sabot may have the advantages set forth above in conjunction with the projectile in accordance with the invention and the combination of projectile and sabot.

The projectile in accordance with the invention, the combination of projectile and sabot, and the acceleration device with the combination of projectile and sabot may also have the following advantages:

- a real bird is realistically, representatively and reproducibly simulated; and
- the projectile is substantially dimensionally stable in flight.

Further features of the invention are presented in the following description and the drawings of embodiments.

DETAILED DESCRIPTION OF THE INVENTION

Figure 1:
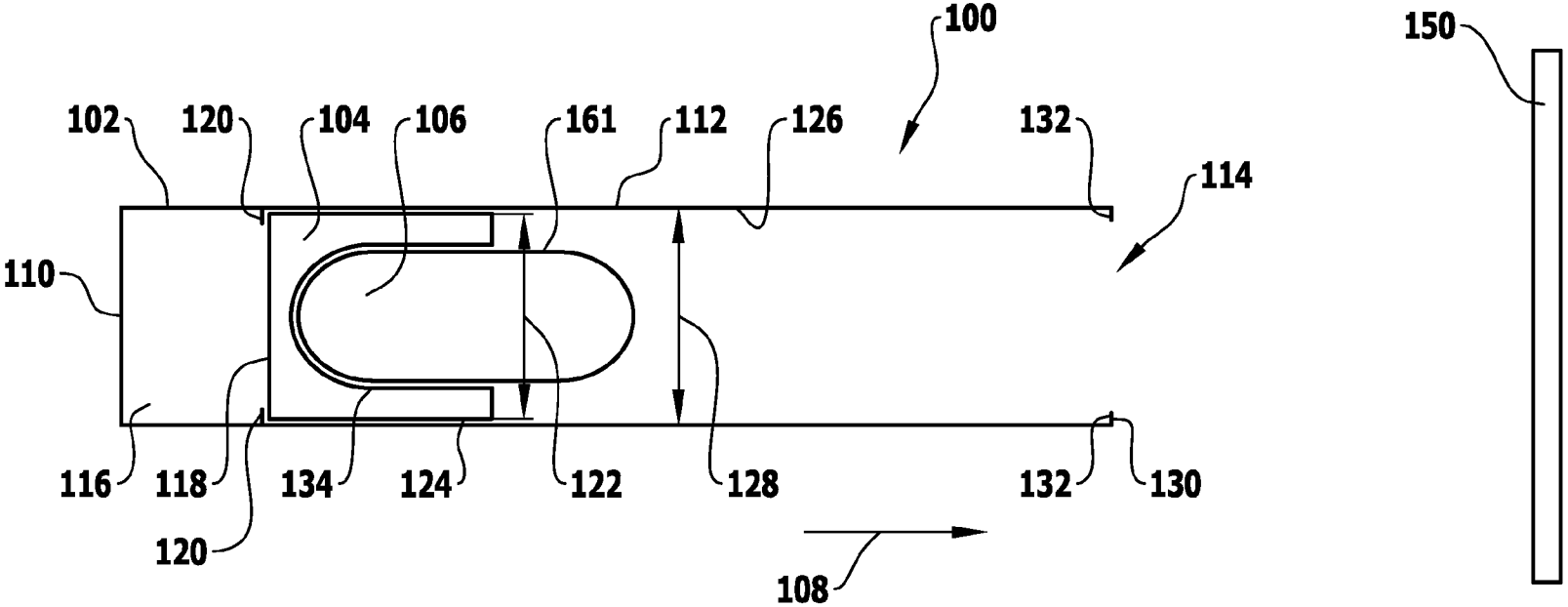
FIG. 1 shows a diagrammatic representation of a gas gun with a first embodiment of a sabot and a first embodiment of a projectile.

Identical or functionally equivalent elements are given the same reference numerals in all Figures.

A gas gun shown in FIGS. 1 and 3 to 6 and designated in its entirety by 100 comprises a main body 102, a sabot 104 and a projectile 106 arranged in the sabot 104.

The gas gun 100 is an acceleration device and serves to accelerate the projectile 106 by means of the sabot 104 in a direction of acceleration 108.

The main body 102 is of cylindrical and hollow construction and comprises a rear end 110 in the direction of acceleration 108, a barrel 112 and a front outlet 114 in the direction of acceleration 108.

Arranged at the rear end 110 of the main body 102 is a propellant chamber 116, which in the direction of acceleration 108 borders at the front on a rear wall 118 of the sabot 104 when the sabot 104 is arranged in an initial position (see FIG. 1).

Stops 120 against which the sabot 104 bears in the initial position with the rear wall 118 are provided on the main body 102 to lock the sabot 104 in the direction opposite to the direction of acceleration 108.

The sabot 104 is of substantially cylindrical and solid construction.

An outer diameter 122 of the sabot 104 is selected so that an outer lateral surface 124 of the sabot 104 can slide along an inner lateral surface 126 of the barrel 112.

An inner diameter 128 of the barrel 112 of the main body 102 is, therefore, slightly larger than the outer diameter 122 of the sabot 104.

Sabot stoppers 132 are provided at a front end 130 of the main body 102 in the direction of acceleration 108 for restricting movement of the sabot 104 in the direction of acceleration 108.

The barrel 112 of the main body 102 of the gas gun 100 extends from the stops 120 to the sabot stoppers 132.

The sabot 104 comprises a receptacle 134 for receiving the projectile 106.

The receptacle 134 is of complementary construction to a section of the projectile 106 so as to be able to easily receive this section.

Figure 2:
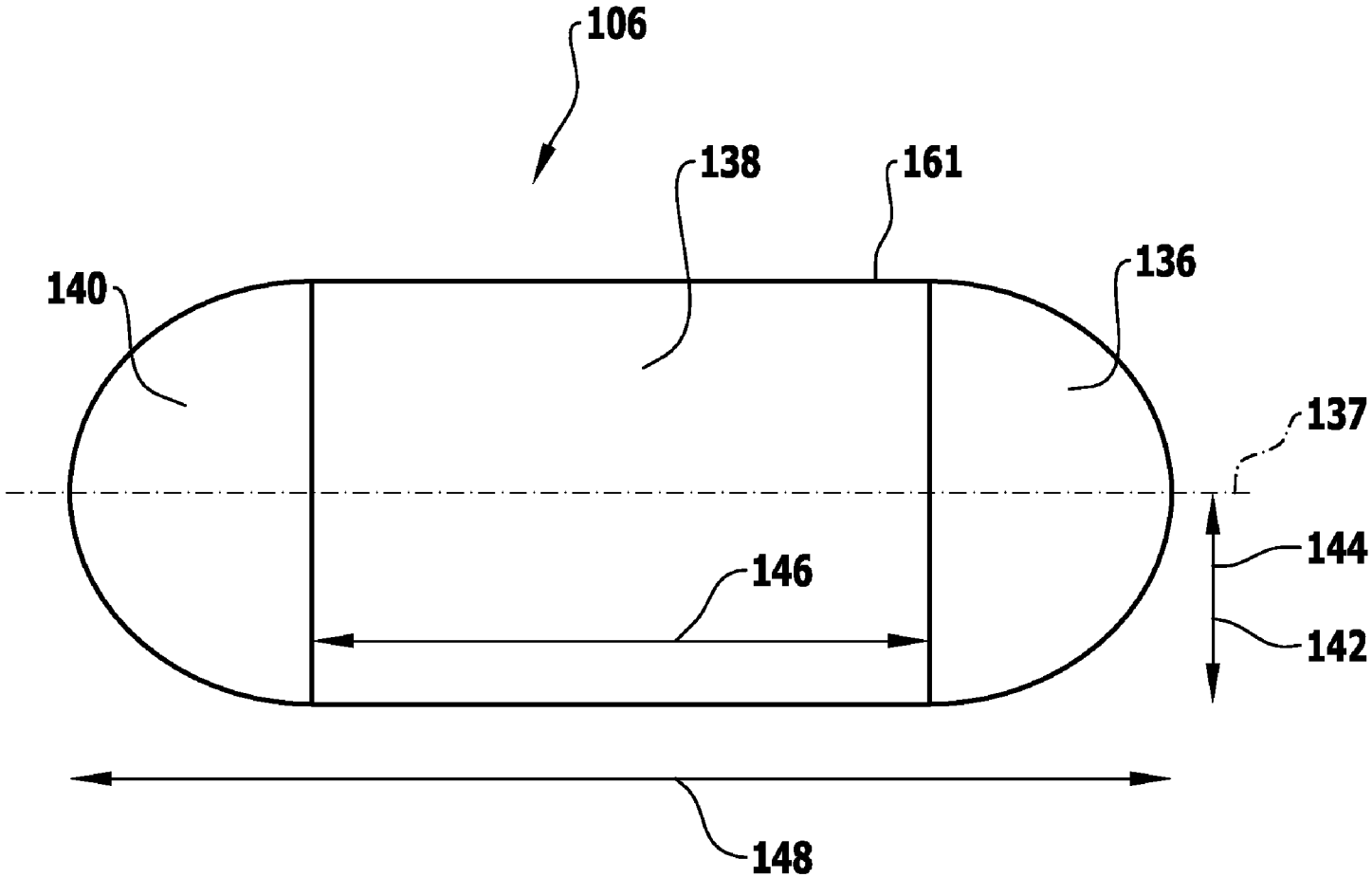
FIG. 2 shows a diagrammatic representation of the projectile from FIG. 1.

The projectile 106 is of rotationally symmetrical construction with respect to an axis of rotation 137 and comprises a front hemispherical section 136, a cylindrical section 138 located centrally and a rear hemispherical section 140, the hemispherical sections 136 and 140 having, for example, a substantially identical radius 142 (see FIG. 2).

The radius 142 of the front hemispherical section 136 and of the rear hemispherical section 140 corresponds, for example, approximately to a radius 144 of the cylindrical section 138 of the projectile 106 and, for example, approximately to half of a length 146 of the cylindrical section 138.

A length 148 of the projectile 106 therefore corresponds, for example, approximately to four times the radius 142 of the front hemispherical section 136 and of the rear hemispherical section 140.

In the initial position, the projectile 106 is arranged in the receptacle 134 of the sabot 104 so that the receptacle 134 surrounds the rear hemispherical section 140 and, for example, approximately half of the cylindrical section 138 of the projectile 106 (see FIG. 1).

In an embodiment (not shown) of the sabot 104, the projectile 106 is substantially completely received in the sabot 104.

The gas gun 100 described above with the sabot 104 and the projectile 106 operates in the following way:

A compressed gas or gas mixture is introduced into the propellant chamber 116 of the main body 102 of the gas gun 100.

The resulting rise in pressure in the propellant chamber 116 causes a force to be applied to the rear wall 118 of the sabot 104 and hence the sabot 104 including the projectile 106 to be accelerated in the direction of acceleration 108 to, for example, approximately 70 m/s to simulate an impact on rotor blades (not shown) of a wind power plant.

Figure 3:
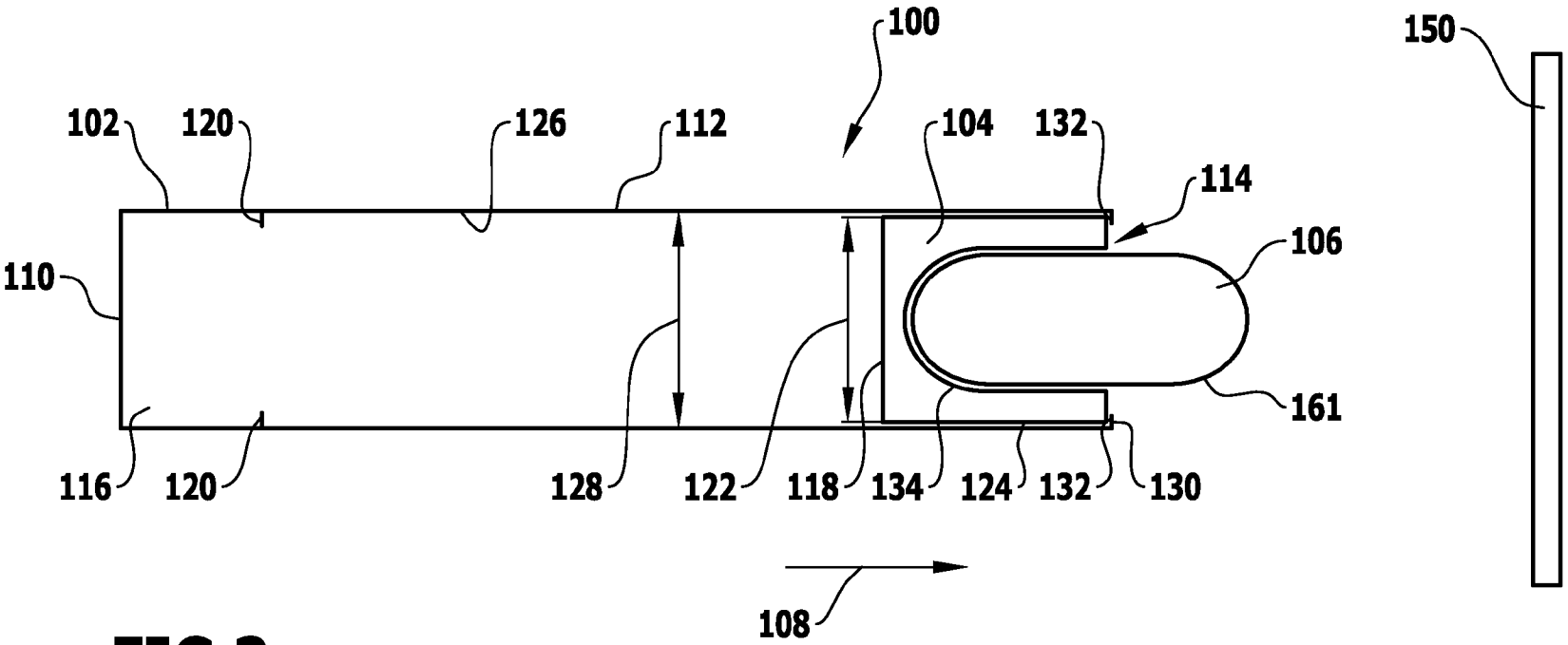
FIG. 3 shows a diagrammatic representation of the gas gun from FIG. 1, in which the sabot is arranged with the projectile at the end of an acceleration section of the gas gun.

The sabot 104 of the projectile 106 is thus brought in the direction of acceleration 108 from the initial position to an end position at the front end 130 of the main body 102 (see FIG. 3).

The sabot 104 is braked by the sabot stoppers 132.

The projectile 106 held loosely in the sabot 104 separates from the sabot 104 on account of its inertia and flies in the direction of acceleration 108 towards a target 150.

Figure 4:
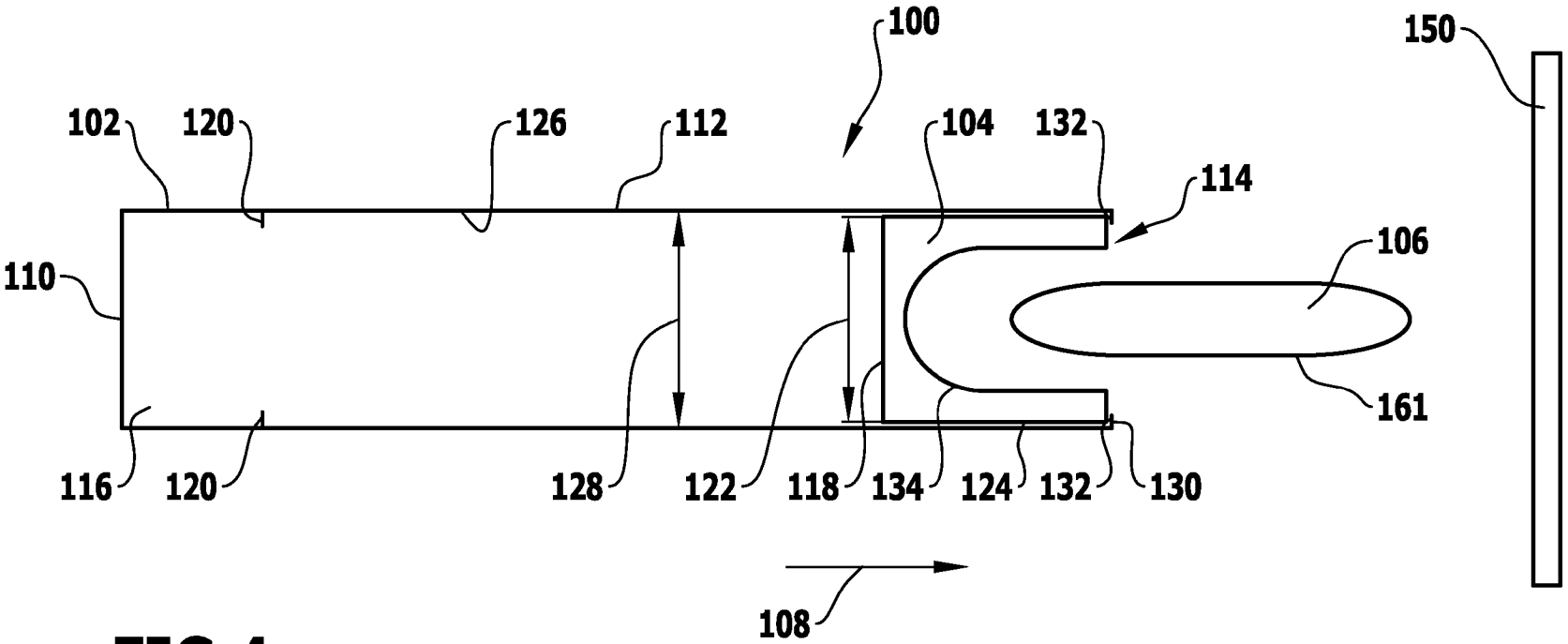
FIG. 4 shows a diagrammatic representation of the gas gun from FIG. 3, with the projectile deformed by the air resistance.
Figure 5:
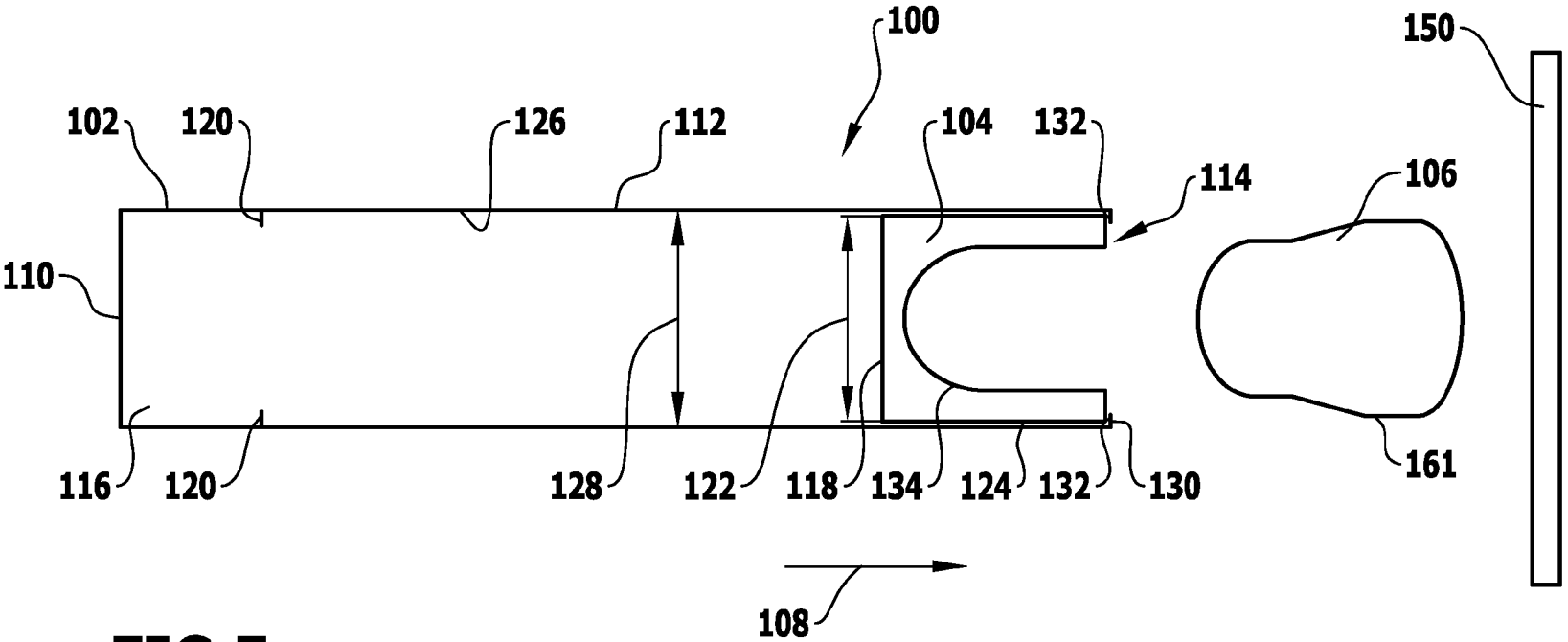
FIG. 5 shows a diagrammatic representation of the gas gun from FIG. 3, with the projectile deformed by the air resistance.

During the flight phase the projectile 106 is deformed by the air resistance (see FIGS. 4 and 5).

Figure 6:
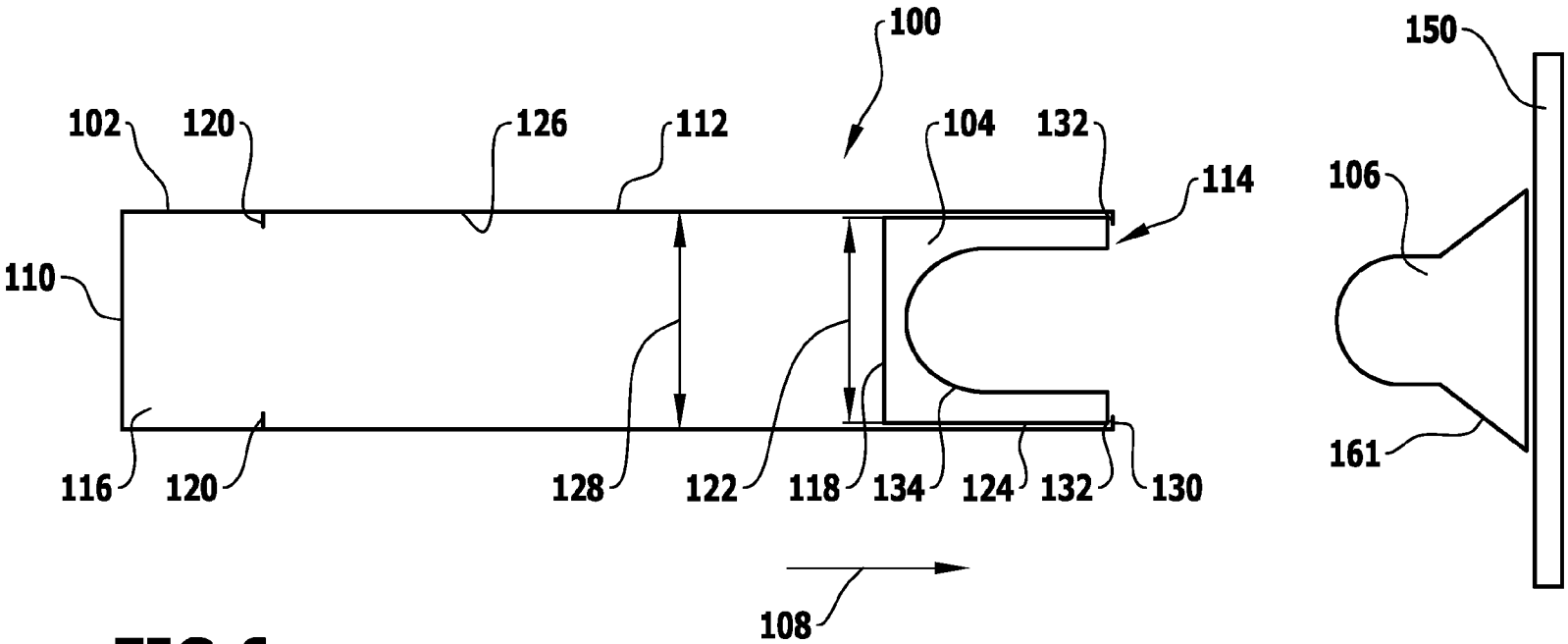
FIG. 6 shows a diagrammatic representation of the gas gun from FIG. 3, with the projectile striking a target.

The deformations shown in FIGS. 4 and 5 result in an inaccuracy in the reproducibility of the impact of the projectile 106 on the target 150 shown in FIG. 6.

Figure 7:
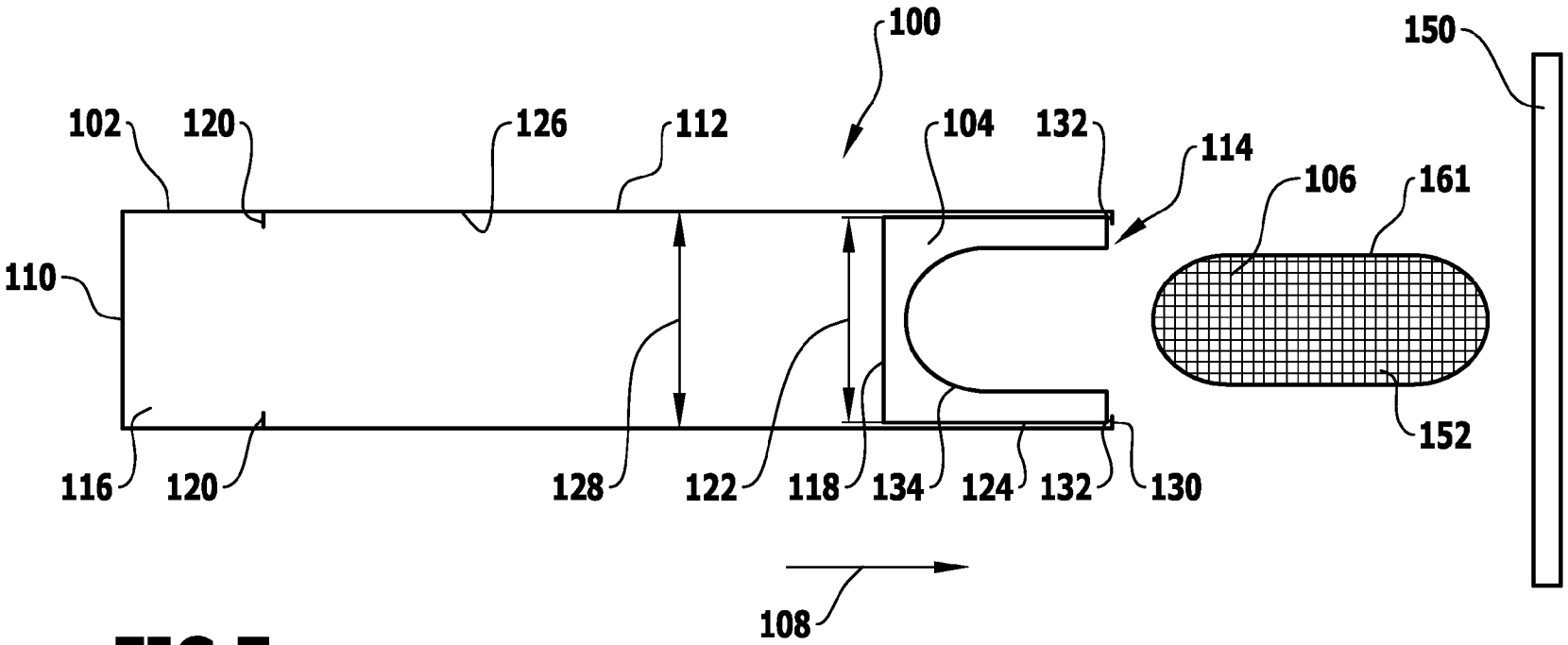
FIG. 7 shows a diagrammatic representation of the gas gun from FIG. 3, with a second embodiment of a projectile.

A second embodiment of the projectile 106 shown in FIG. 7 comprises, in particular, for stabilization of the projectile 106 in the flight phase a stabilizing device 152.

The deformations of the projectile 106 caused by the air resistance can be reduced, in particular, avoided altogether by means of the stabilizing device 152.

The stabilizing device 152 is formed by square honeycombs and extends in both the radial and the axial direction over the entire extent of the projectile 106.

To produce the projectile 106, the stabilizing device 152 is placed in a mold into which, for example, a mixture of gelatin and water is subsequently introduced.

Apart from that, the embodiment of the gas gun 100 shown in FIG. 7 with the sabot 104 and the projectile 106 corresponds with respect to construction and operation to the embodiment of the gas gun 100 shown in FIGS. 1 and 3 to 6 with the sabot 104 and the projectile 106, to the above description of which reference is made in this respect.

Figure 8:
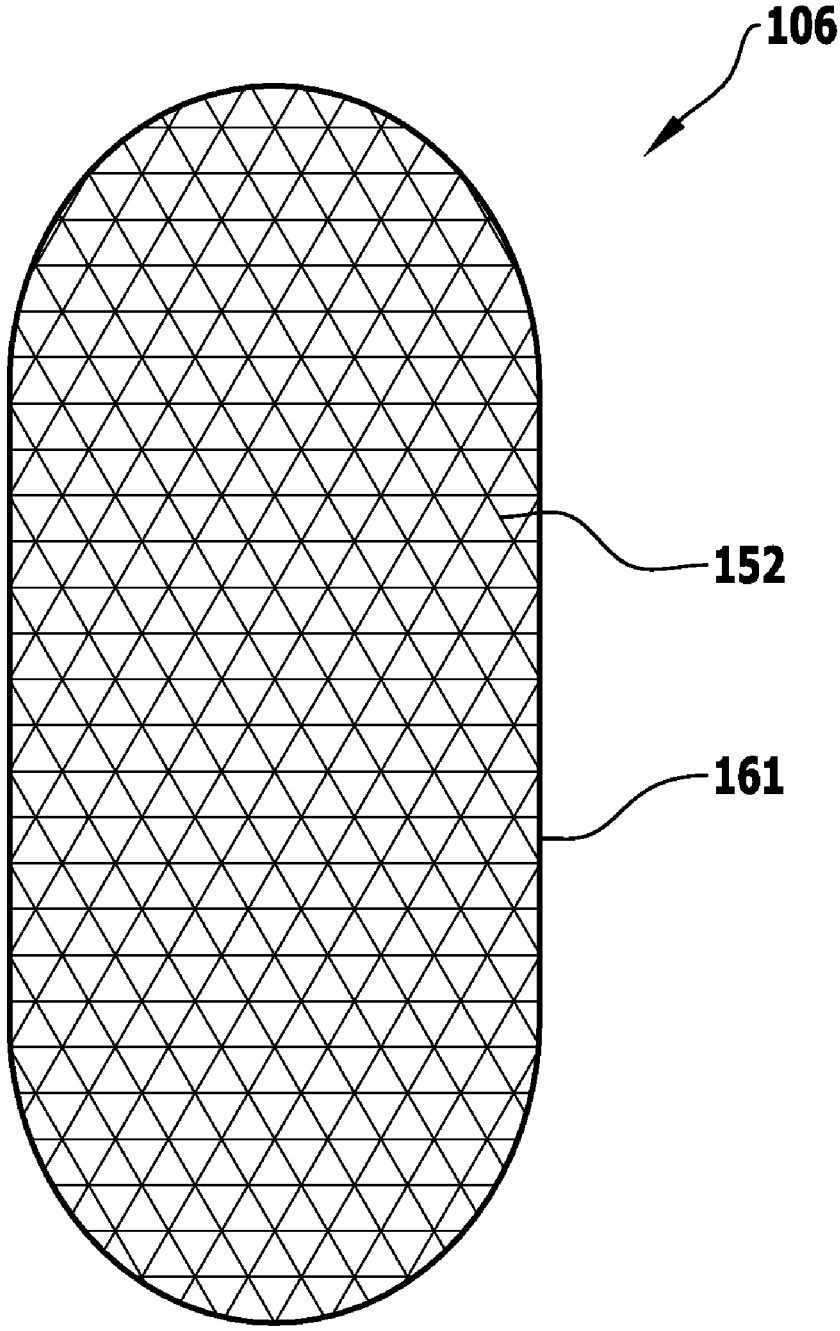
FIG. 8 shows a diagrammatic representation of a third embodiment of a projectile.

The third embodiment of the projectile 106 shown in FIG. 8 differs from the embodiment shown in FIG. 7 in that instead of a square honeycomb pattern, the stabilizing device 152 has a triangular honeycomb pattern.

Apart from that, the third embodiment of the projectile 106 shown in FIG. 8 corresponds with respect to construction and operation to the second embodiment shown in FIG. 7, to the above description of which reference is made in this respect.

In an embodiment (not shown) of the projectile 106 corresponding substantially to the third embodiment shown in FIG. 8, the honeycomb pattern is a hexagonal honeycomb pattern.

Figure 9:
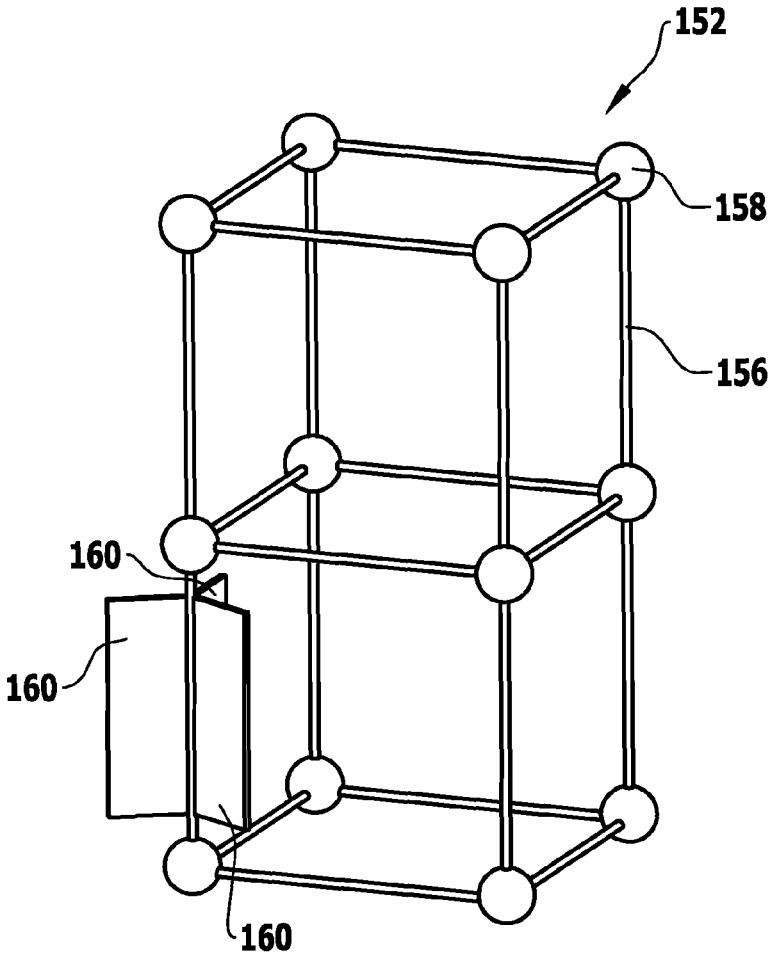
FIG. 9 shows a diagrammatic perspective representation of a stabilizing device with a cubic basic shape of a fourth embodiment of a projectile.

A fourth embodiment of the projectile 106 shown in FIG. 9 differs from the second embodiment shown in FIG. 7 in that the stabilizing device 152 comprises a cubic lattice formed by stabilizing elements 156.

The stabilizing elements 156 are connected to one another by connecting elements 158.

Lamellae 160 which are, for example, rectangular, are provided on the stabilizing elements 156 for further stabilization of the projectile 106. Such lamellae 160 can be provided on individual stabilizing elements 156 or also on all stabilizing elements 156.

Apart from that, the fourth embodiment of the projectile 106 shown in FIG. 9 corresponds with respect to construction and operation to the second embodiment shown in FIG. 7, to the above description of which reference is made in this respect.

Figure 10:
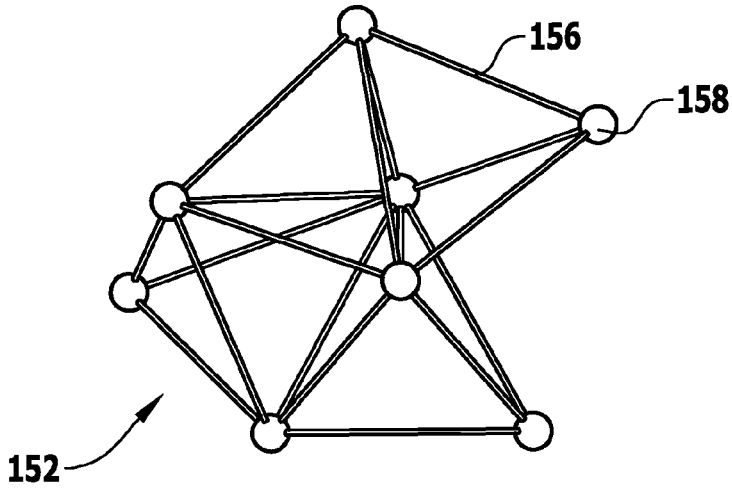
FIG. 10 shows a diagrammatic perspective representation of a stabilizing device with a tetrahedral basic shape of a fifth embodiment of a projectile.

A fifth embodiment of the projectile 106 shown in FIG. 10 differs from the fourth embodiment shown in FIG. 9 in that instead of a cubic lattice, a tetrahedral lattice is provided, which is formed by a plurality of stabilizing elements 156.

Apart from that, the fifth embodiment of the projectile 106 shown in FIG. 10 corresponds with respect to construction and operation to the fourth embodiment shown in FIG. 9, to the above description of which reference is made in this respect.

Figure 11:
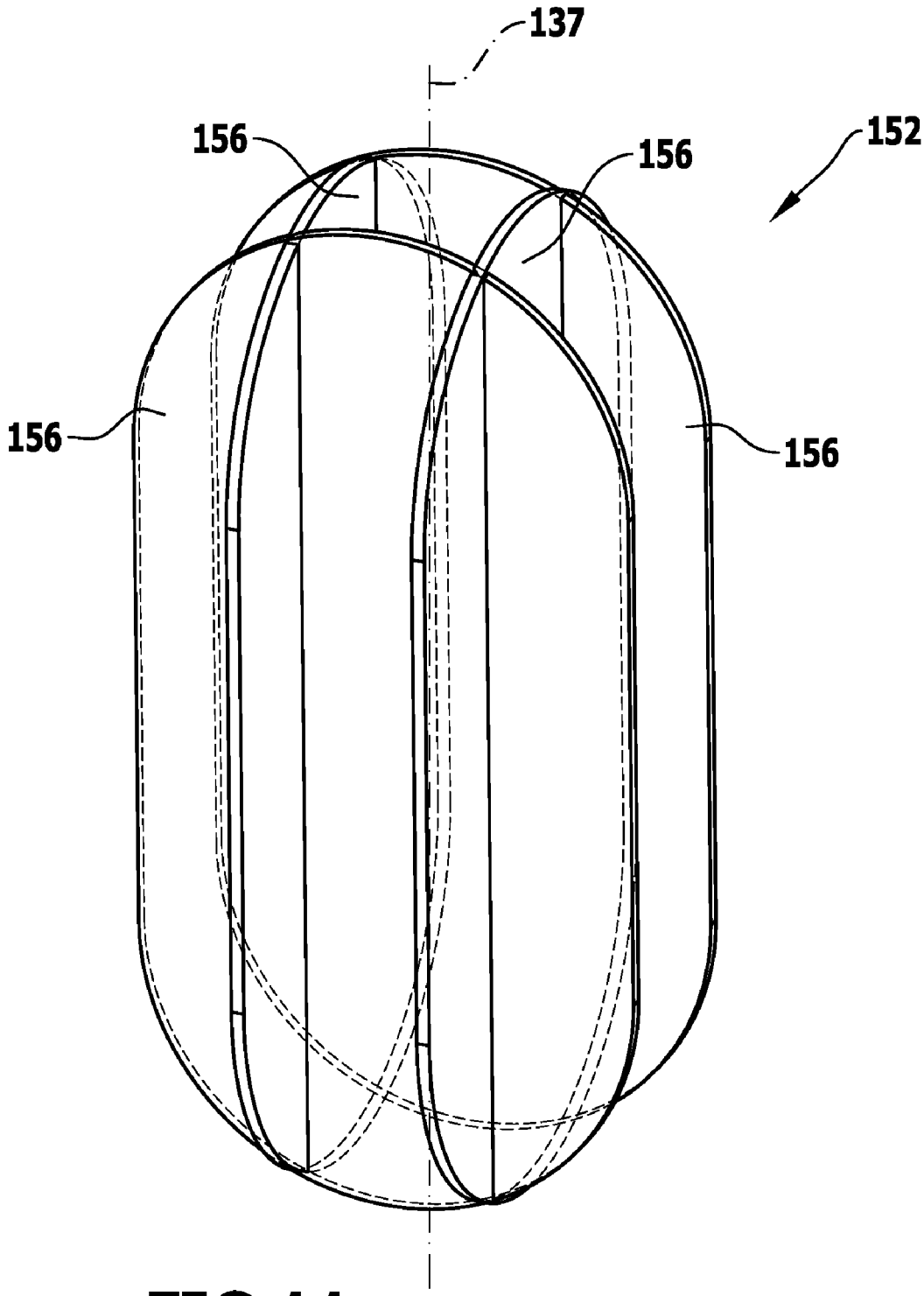
FIG. 11 shows a diagrammatic perspective representation of a stabilizing device of a sixth embodiment of a projectile.

A stabilizing device 152 of a sixth embodiment of the projectile 106 shown in FIG. 11 differs from the second embodiment shown in FIG. 7 in that the stabilizing device 152 is formed by four substantially identical plate-shaped stabilizing elements 156.

Two of the plate-shaped stabilizing elements 156 are arranged parallel to each other, parallel to the axis of rotation 137 of the projectile 106 and at a distance from each other which corresponds, for example, approximately to the radius 142 of the hemispherical sections 136 and 140 of the projectile 106.

The two stabilizing elements 156 are arranged in mirror-symmetrical relation to each other with respect to the axis of rotation 137 of the projectile 106 and extend along the largest extent of the projectile 106 and in a direction transverse thereto as far as a surface 161 of the projectile 106 in each case.

The two further plate-shaped stabilizing elements 156 correspond in their extent, their position relative to each other and their arrangement on the projectile 106 to the previously described plate-shaped stabilizing elements 156, but are arranged at, for example, approximately 90° to the previously described two plate-shaped stabilizing elements 156 with respect to the axis of rotation 137 of the projectile 106.

In a viewing direction along the axis of rotation 137 of the projectile 106, an arrangement of the plate-shaped stabilizing elements 156 thus corresponds substantially to a hash sign.

One or more stabilizing plates (not shown) aligned substantially perpendicularly to the axis of rotation 137 may also be provided for further reinforcement of the stabilizing device 152.

Apart from that, the sixth embodiment of the projectile 106 shown in FIG. 11 corresponds with respect to construction and operation to the second embodiment shown in FIG. 7, to the above description of which reference is made in this respect.

Figure 12:
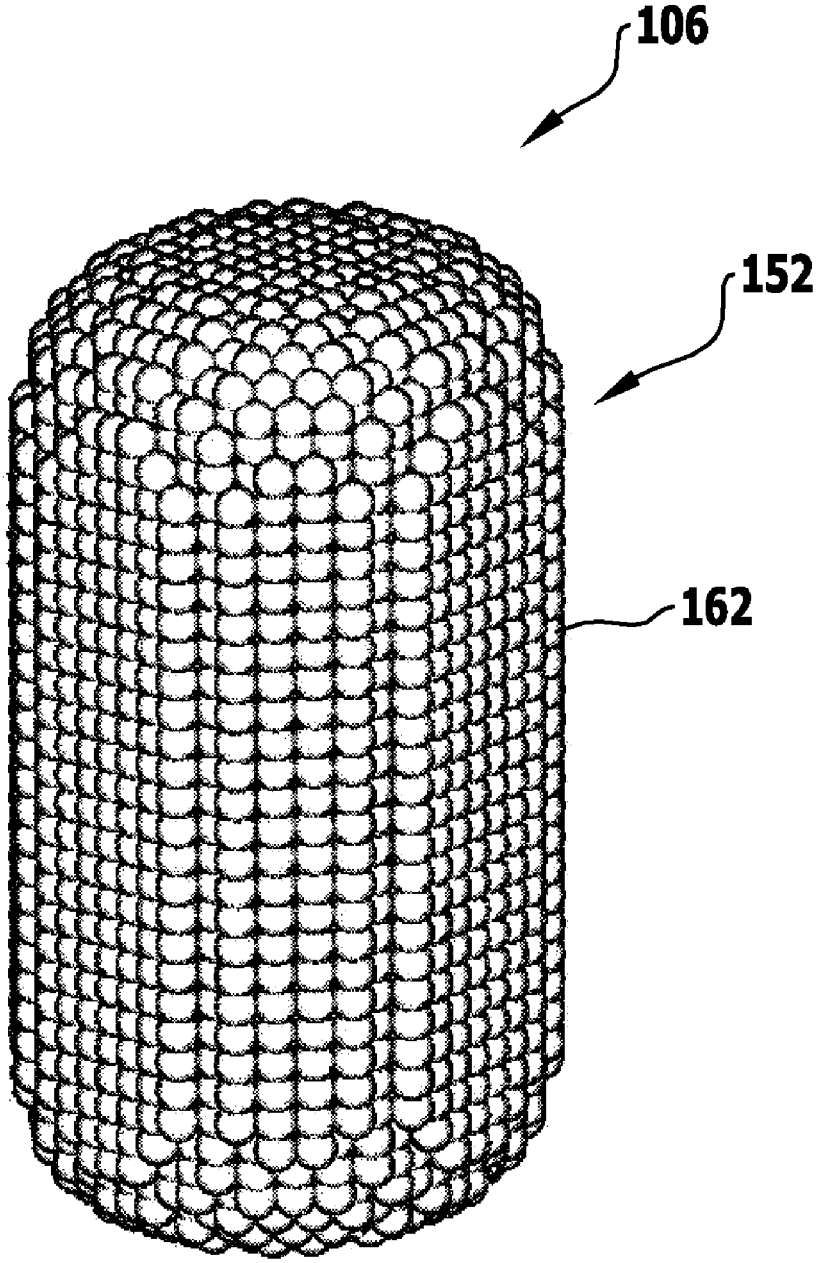
FIG. 12 shows a diagrammatic perspective representation of a seventh embodiment of a projectile.

A seventh embodiment of the projectile 106 shown in FIG. 12 differs from the second embodiment shown in FIG. 7 in that the stabilizing device 152 is formed by a plurality of hollow bodies in the form of hollow balls 162.

The hollow balls 162 are filled with the gel-like or jelly-like material and are arranged on one another and connected to one another in such a way that the projectile 106 has substantially the same outer contour as the second embodiment of the projectile 106 shown in FIG. 7.

Apart from that, the seventh embodiment of the projectile 106 shown in FIG. 12 corresponds with respect to construction and operation to the second embodiment shown in FIG. 7, to the above description of which reference is made in this respect.

Figure 13:
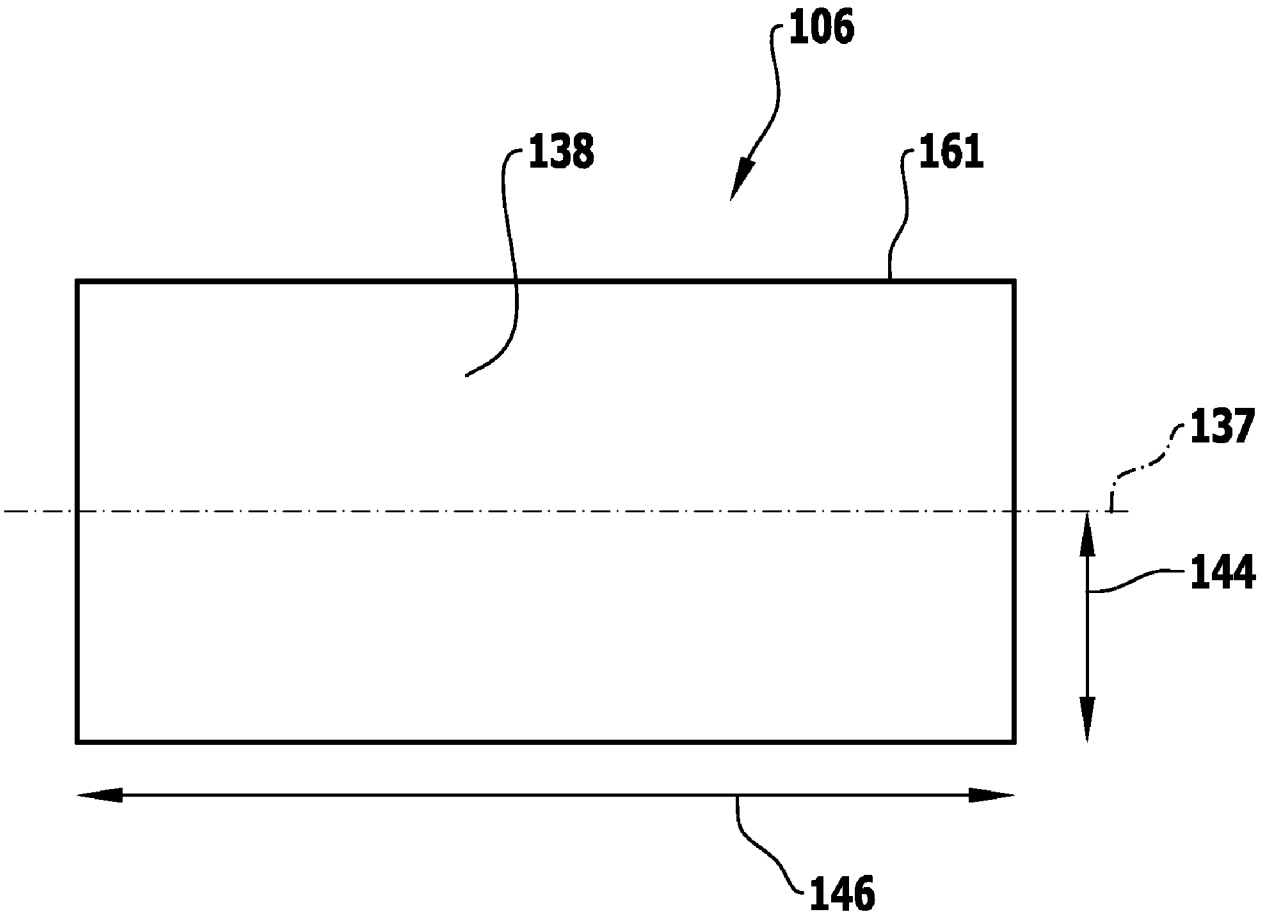
FIG. 13 shows a diagrammatic representation of an eighth embodiment of a projectile.

An eighth embodiment of the projectile 106 shown in FIG. 13 differs from the first embodiment shown in FIGS. 1 to 6 in that the projectile 106 is of cylindrical configuration and has no hemispherical sections.

The length 146 of the cylindrical section 138 in this embodiment is, for example, approximately four times the radius 144 of the cylindrical section 138.

One, or a combination of several, of the stabilizing devices 152 shown in FIGS. 7 to 12 may be provided in the eighth embodiment of the projectile 106.

Apart from that, the eighth embodiment of the projectile 106 shown in FIG. 13 corresponds with respect to construction and operation to the first embodiment shown in FIGS. 1 to 6, to the above description of which reference is made in this respect.

Figure 14:
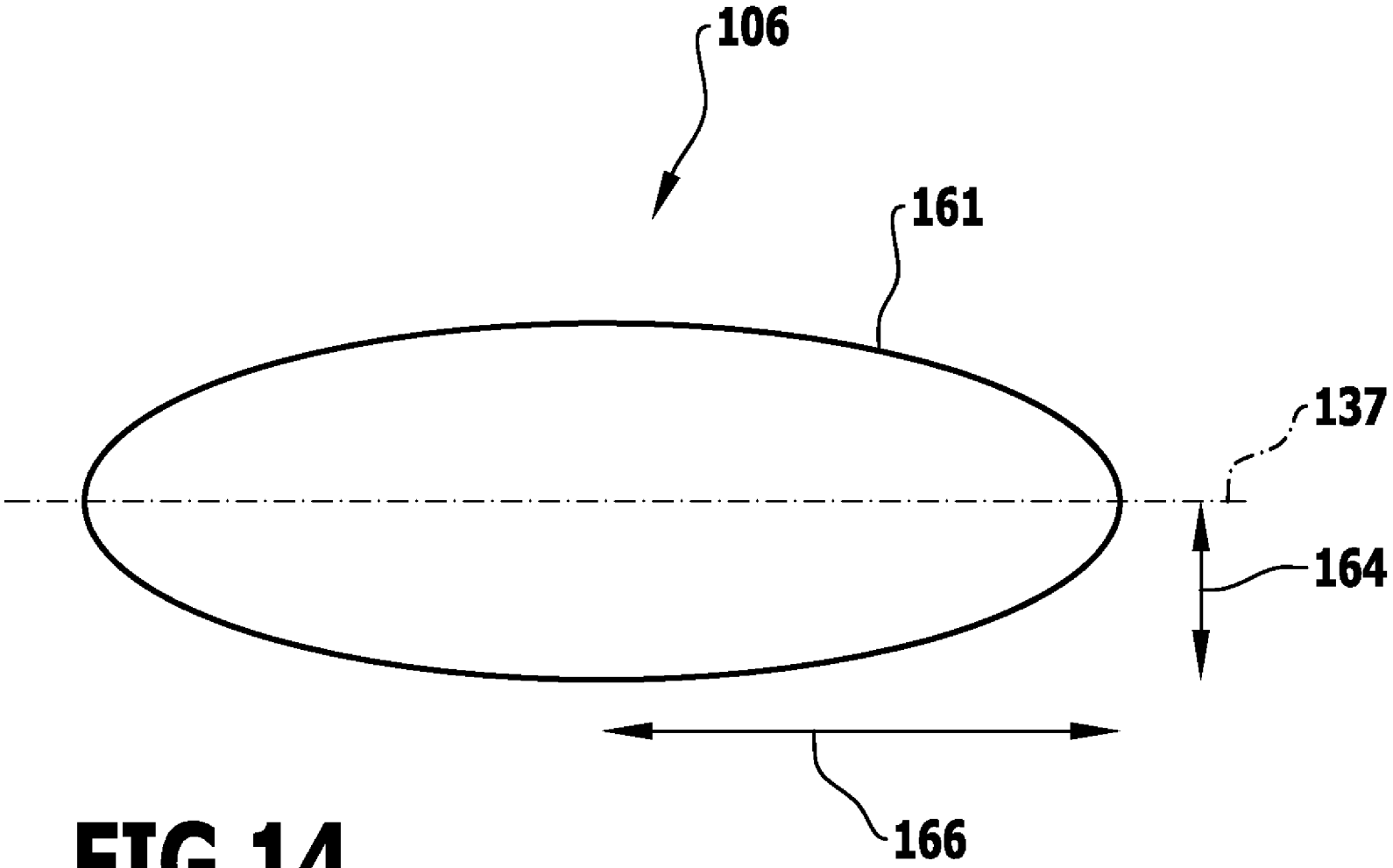
FIG. 14 shows a diagrammatic representation of a ninth embodiment of a projectile.

A ninth embodiment of the projectile 106 shown in FIG. 14 differs from the first embodiment shown in FIGS. 1 to 6 in that the shape of the projectile 106 is an ellipsoid.

A length 164 of the first semiaxis of the ellipsoid in this embodiment is, for example, approximately half of a length 166 of the second semiaxis of the ellipsoid.

The length of the third semiaxis is identical to the length of the first semiaxis, so that the projectile 106 has the shape of an ellipsoid of revolution.

In the ninth embodiment of the projectile 106, one, or a combination of several, of the stabilizing devices 152 shown in FIGS. 7 to 12 may be provided.

Apart from that, the ninth embodiment of the projectile 106 shown in FIG. 14 corresponds with respect to construction and operation to the first embodiment shown in FIGS. 1 to 6, to the above description of which reference is made in this respect.

In principle, each of the projectiles described above may be provided with one of the stabilizing devices described above or with a combination of several of the stabilizing devices described above.

Bird strike tests can be carried out with reproducible and representative results by using projectiles with a stabilizing device.

The invention claimed is:

1. Projectile for bird strike tests, comprising:

a gel or jelly material; and a stabilizing device arranged in the projectile for stabilizing the gel or jelly material, wherein the stabilizing device comprises at least one stabilizing element which is of substantially bar-shaped configuration, and wherein a material of which at least a section of the stabilizing device is formed has substantially the same density as the gel or jelly material.

2. Projectile in accordance with claim 1, wherein the gel or jelly material comprises gelatin or consists of gelatin.

3. Projectile in accordance with claim 2, wherein the gel or jelly material comprises ballistic gelatin or consists of ballistic gelatin.

4. Projectile in accordance with claim 1, wherein the gel or jelly material comprises at least one of silicone rubber, glycerin soap, starch, polymer gel, caoutchouc, latex, and plasticine or consists of at least one of silicone rubber, glycerin soap, starch, polymer gel, caoutchouc, latex, and plasticine.

5. Projectile in accordance with claim 1, wherein the gel or jelly material has a gel strength of from approximately 200 Bloom to approximately 300 Bloom.

6. Projectile in accordance with claim 1, wherein the projectile comprises hollow bodies.

7. Projectile in accordance with claim 6, wherein the hollow bodies are filled at least partly with the gel or jelly material.

8. Projectile in accordance with claim 6, wherein the hollow bodies are surrounded at least partly by the gel or jelly material.

9. Projectile in accordance with claim 6, wherein the projectile comprises hollow bodies that are connected to one another.

10. Projectile in accordance with claim 1, wherein the projectile has, at least in sections thereof, a substantially cylindrical shape.

11. Projectile in accordance with claim 1, wherein the projectile is, at least on one side thereof, of substantially hemispherical configuration.

12. Projectile in accordance with claim 1, wherein the projectile is of substantially hemispherical configuration on either side of a middle section.

13. Projectile in accordance with claim 1, wherein the projectile is configured, at least in sections thereof, substantially as an ellipsoid.

14. Projectile in accordance with claim 1, wherein the projectile has a mass of at least approximately 1.5 kg.

15. Projectile in accordance with claim 1, wherein the projectile has a mass of at most approximately 4 kg.

16. Projectile in accordance with claim 1, wherein the stabilizing device is formed, at least in sections thereof, of paper or cardboard.

17. Projectile in accordance with claim 1, wherein the stabilizing device is formed, at least in sections thereof, of stabilizing elements arranged in a geometrical pattern.

18. Projectile in accordance with claim 17, wherein the geometrical pattern is based on a cubic or tetrahedral basic shape.

19. Projectile in accordance with claim 1, wherein the stabilizing device comprises at least one main support.

20. Projectile in accordance with claim 1, wherein the stabilizing device comprises a plurality of stabilizing elements which are arranged on at least one main support.

21. Projectile in accordance with claim 1, wherein the projectile is surrounded, at least in sections thereof, by a substantially water-impermeable material.

22. Projectile in accordance with claim 21, wherein the projectile is provided with a water-impermeable coating.

23. Projectile in accordance with claim 1, wherein at least one stabilizing element is provided with at least one lamella.

24. Combination of a projectile for bird strike tests and a sabot for receiving and accelerating the projectile in an acceleration device, the projectile comprising:

a gel or jelly material; and a stabilizing device arranged in the projectile for stabilizing the gel or jelly material, wherein the stabilizing device comprises at least one stabilizing element which is of substantially bar-shaped configuration, wherein a material of which at least a section of the stabilizing device is formed has substantially the same density as the gel or jelly material.

25. Combination in accordance with claim 24, wherein the sabot comprises a receptacle for the projectile, the shape of which, at least in sections thereof, is complementary to that of at least one section of the projectile.

26. Combination in accordance with claim 24, wherein the sabot is constructed so as to be separable in a longitudinal center plane.

27. Acceleration device for accelerating a combination of a projectile for bird strike tests and a sabot for receiving and accelerating the projectile, the projectile comprising:

a gel or jelly material; and a stabilizing device arranged in the projectile for stabilizing the gel or jelly material, wherein the stabilizing device comprises at least one stabilizing element which is of substantially bar-shaped configuration, and wherein a material of which at least a section of the stabilizing device is formed has substantially the same density as the gel or jelly material.

* * * * *